US008046894B2

(12) United States Patent
Williams

(10) Patent No.: US 8,046,894 B2
(45) Date of Patent: Nov. 1, 2011

(54) DIORAMA AND METHOD OF MAKING THE SAME

(75) Inventor: Anthony D. Williams, San Carlos, CA (US)

(73) Assignee: Axial-Digital Corp., San Carlos, CA (US)

( * ) Notice: Subject to any disclaimer, the term of this patent is extended or adjusted under 35 U.S.C. 154(b) by 63 days.

(21) Appl. No.: 12/646,597

(22) Filed: Dec. 23, 2009

(65) Prior Publication Data

US 2011/0035976 A1 Feb. 17, 2011

Related U.S. Application Data

(63) Continuation-in-part of application No. 12/539,485, filed on Aug. 11, 2009.

(51) Int. Cl.
*B21D 39/02* (2006.01)
*G09F 1/06* (2006.01)

(52) U.S. Cl. ..... 29/463; 40/124.14

(58) Field of Classification Search ..... 29/462, 29/428, 463

See application file for complete search history.

(56) References Cited

U.S. PATENT DOCUMENTS

| | | | | |
|---|---|---|---|---|
| 1,215,962 | A | 2/1917 | Morrison et al. | |
| 1,853,615 | A | 4/1932 | Howard | |
| 2,059,964 | A | 11/1936 | Hempstone | |
| 2,102,553 | A | 12/1937 | Cohen | |
| 2,154,087 | A * | 4/1939 | Fawcett | 40/124.09 |
| 2,312,644 | A | 3/1943 | Horr | |
| 2,314,721 | A | 3/1943 | Lowenstein | |
| 2,731,748 | A | 1/1956 | Polay | |
| 3,363,360 | A | 1/1968 | Ryan | |
| 3,664,049 | A | 5/1972 | Smith | |
| 4,146,984 | A | 4/1979 | Lindquist | |
| 4,778,392 | A | 10/1988 | Mitchell | |
| 5,317,823 | A | 6/1994 | Brunt, II | |
| 6,173,515 | B1 | 1/2001 | Walsh | |
| 6,249,278 | B1 | 6/2001 | Segan et al. | |
| 6,606,407 | B1 * | 8/2003 | Takahashi et al. | 382/164 |
| 7,258,592 | B2 | 8/2007 | Colak | |
| 2002/0110652 | A1 | 8/2002 | Conk | |
| 2004/0190063 | A1 * | 9/2004 | Brown | 358/1.18 |
| 2005/0099414 | A1 * | 5/2005 | Kaye et al. | 345/419 |
| 2006/0046603 | A1 | 3/2006 | Colak | |
| 2007/0240345 | A1 * | 10/2007 | Davis | 40/453 |
| 2008/0178501 | A1 | 7/2008 | Crowell et al. | |
| 2008/0253608 | A1 | 10/2008 | Long et al. | |

* cited by examiner

*Primary Examiner* — John C Hong
(74) *Attorney, Agent, or Firm* — Edward S. Wright

(57) ABSTRACT

Diorama made from a two-dimensional image having a background panel in which a background section of the image appears and a plurality of additional panels on which additional sections of the image appear. The additional panels extend forwardly from the background panel, with edges of adjacent ones of the panels coming together and the image flowing continuously between the panels. The two-dimensional image is transformed into a diorama by constructing a three-dimensional model of the diorama in the form of a plurality of panels on which different areas of the image will appear, converting the three-dimensional model to a two-dimensional layout guide with lines outlining the panels, using the layout guide as a template for adjusting the shape and size of selected areas of the two-dimensional image to match the guide lines on the layout guide, printing the adjusted image, trimming the printed image along facing edges of adjacent ones of the panels, and bringing the trimmed edges together to form a continuous three-dimensional image.

18 Claims, 14 Drawing Sheets

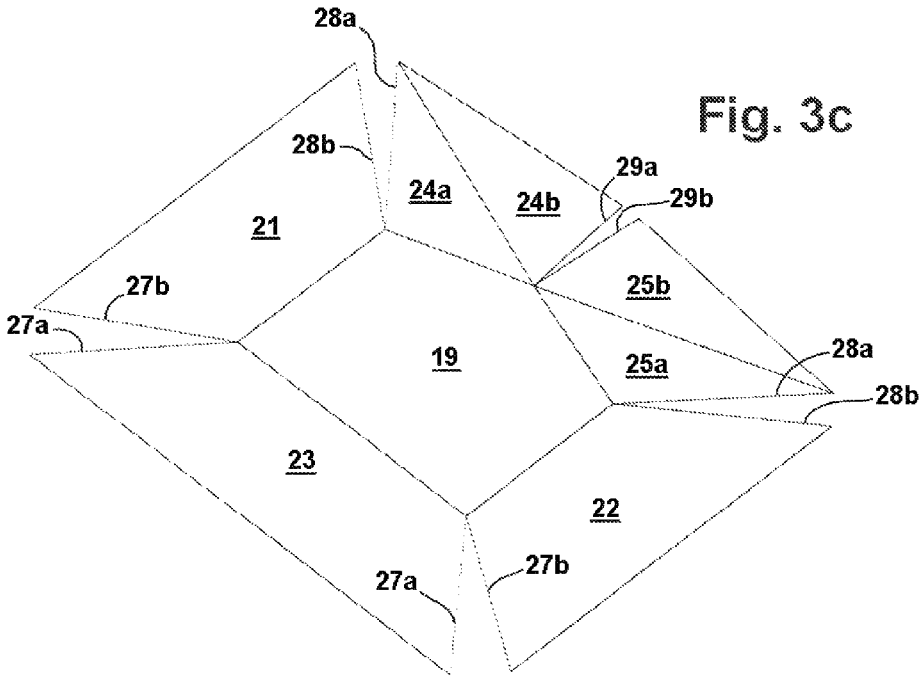
Fig. 3c
Fig. 3d
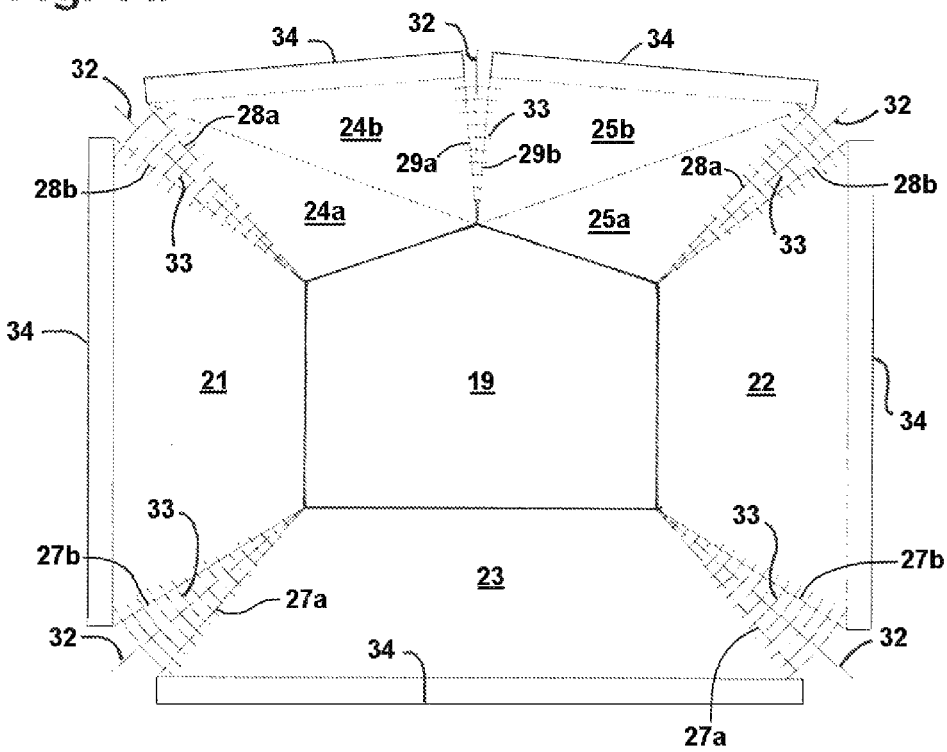

Fig. 6
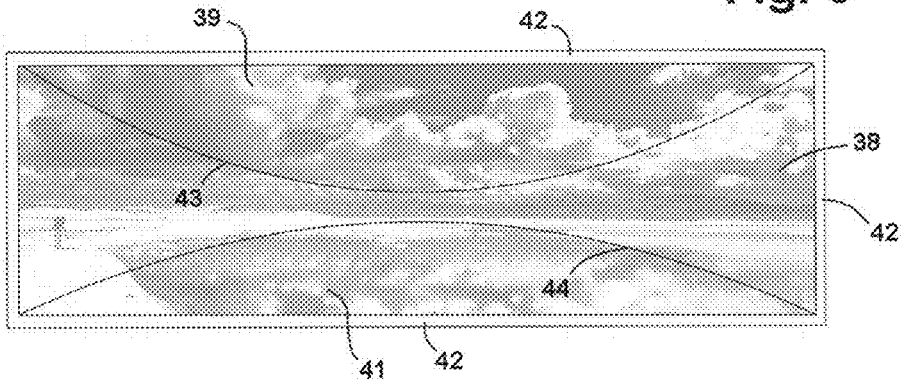
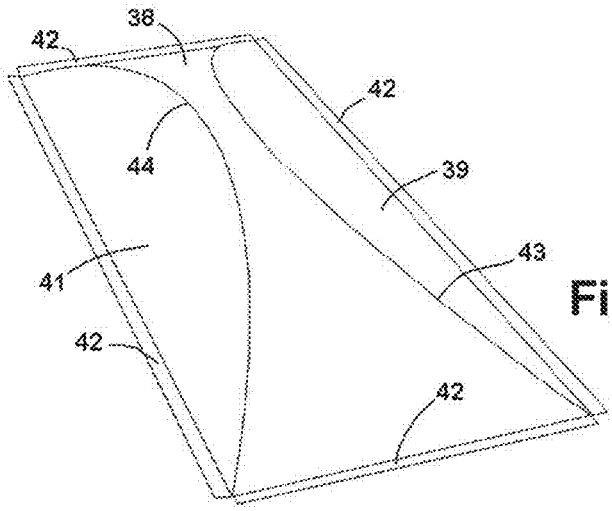
Fig. 7
Fig. 8
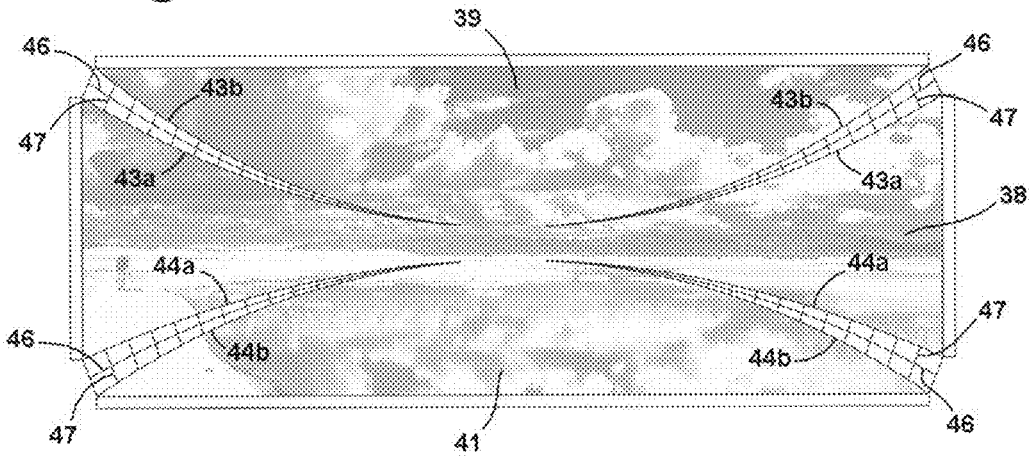

Fig. 9
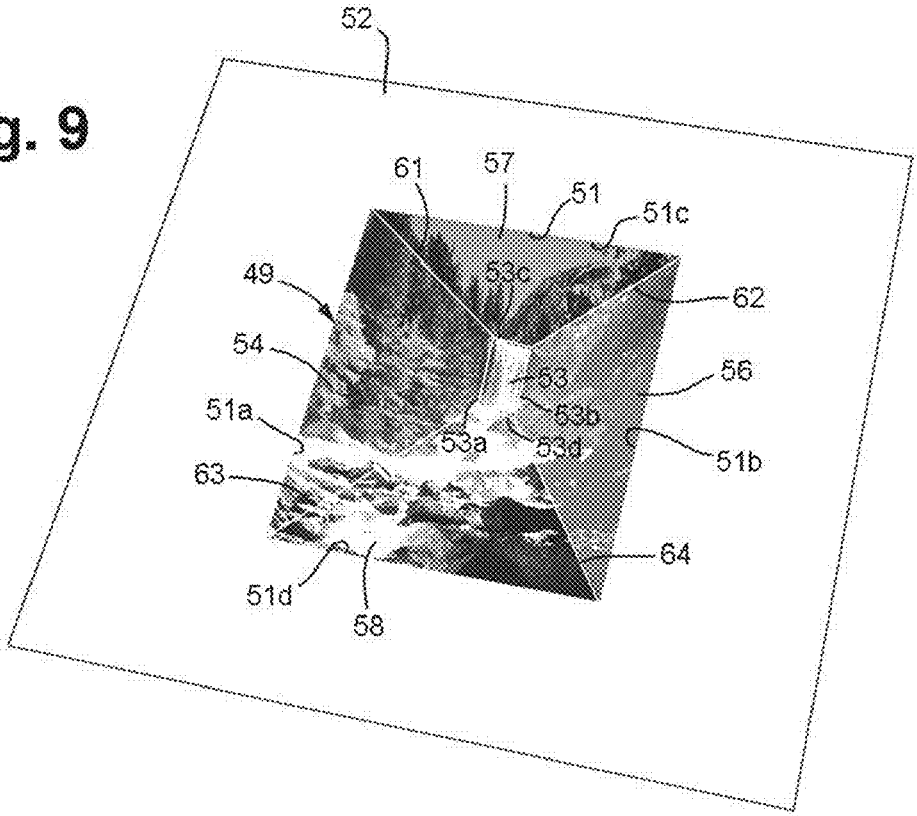
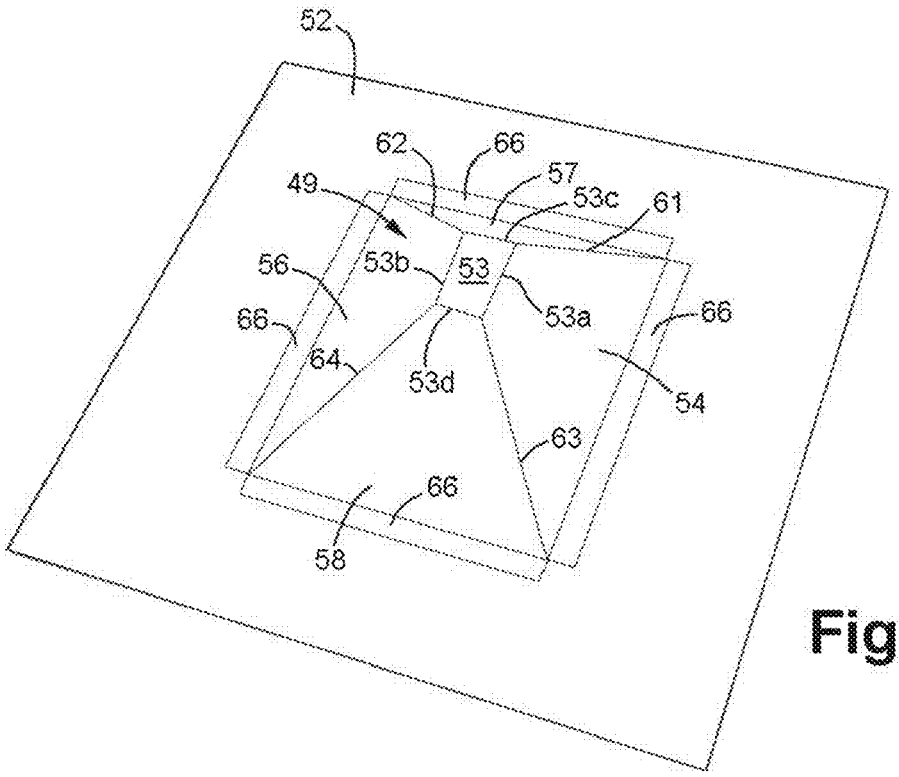
Fig. 10

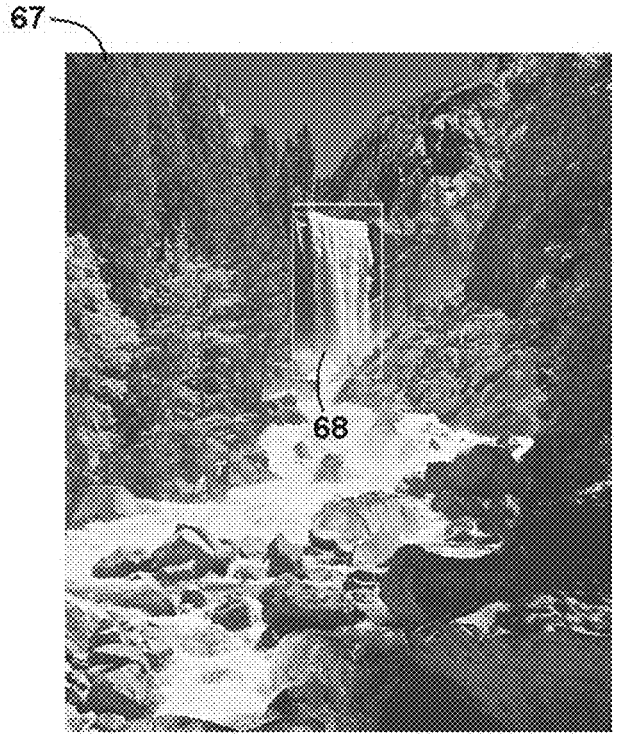
Fig. 11
Fig. 12
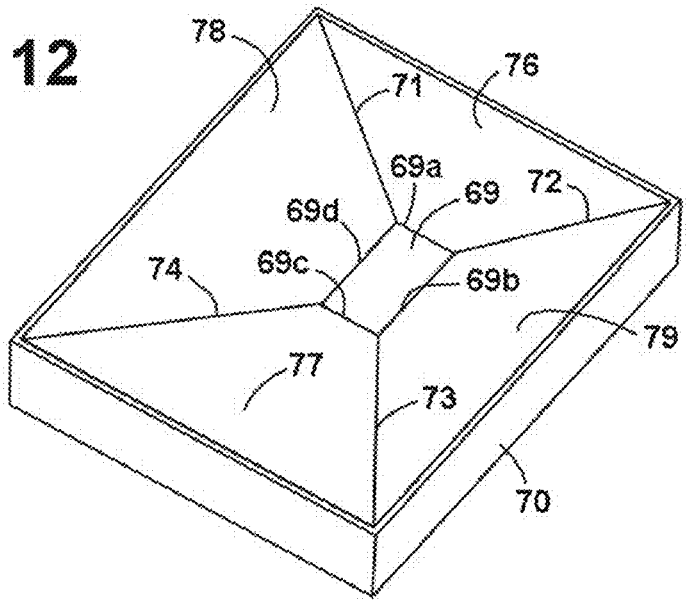

DIORAMA AND METHOD OF MAKING THE SAME

RELATED APPLICATIONS

This is a continuation-in-part of Ser. No. 12/539,485, filed Aug. 11, 2009, the priority of which is claimed.

BACKGROUND OF THE INVENTION

1. Field of Invention

This invention pertains generally to three-dimensional images and, more particularly, to a diorama and method of making the same.

2. Related Art

The earliest dioramas were in the form of large images used in theaters. They were printed and/or painted on thin gauze curtains that allowed the theater operators to change the light intensity in front of or behind the gauze curtains, thus changing the mood of the display.

Modern dioramas are typically in the form of three dimensional models, both full and scaled sizes, utilizing three dimensional models of persons and other objects positioned, sometimes on scaled terrain, in front a background image to produce a three-dimensional effect. Such dioramas are sometimes placed in shadow boxes, but fail to provide a true perspective effect.

OBJECTS AND SUMMARY OF THE INVENTION

It is, in general, an object of the invention to provide a new and improved diorama and method of making the same.

Another object of the invention is to provide a diorama and method of the above character in which a realistic perspective effect is created.

These and other objects are achieved in accordance with the invention by providing diorama made from a two-dimensional image having a background panel in which a background section of the image appears and a plurality of additional panels on which additional sections of the image appear. The additional panels extend forwardly from the background panel, with edges of adjacent ones of the panels coming together and the image flowing continuously between the panels.

The two-dimensional image is transformed into a diorama by constructing a three-dimensional model of the diorama in the form of a plurality of panels on which different areas of the image will appear, converting the three-dimensional model to a two-dimensional layout guide with lines outlining the panels, using the layout guide as a template for adjusting the shape and size of selected areas of the two-dimensional image to match the guide lines on the layout guide, printing the adjusted image, trimming the printed image along facing edges of adjacent ones of the panels, and bringing the trimmed edges together to form a continuous three-dimensional image.

BRIEF DESCRIPTION OF THE DRAWINGS

FIGS. 3*a*-3*c* are isometric views illustrating some of the steps in one embodiment of a preferred method of constructing a layout guide for use in making the diorama of FIG. 1.

FIG. 3*d* is a plan view illustrating the remainder of the steps in constructing the layout guide.

FIG. 6 is a front elevational view of another embodiment of a diorama according to the invention.

FIG. 7 is a rear perspective view of the embodiment of FIG. 6.

FIG. 8 is a plan view of a two-dimensional layout of the embodiment of FIG. 6.

FIG. 9 is a front perspective view of another embodiment of a diorama according to the invention.

FIG. 10 is a rear perspective view of the embodiment of FIG. 9.

FIGS. 11-22 illustrate steps in another embodiment of a method of making a diorama in accordance with the invention.

DETAILED DESCRIPTION

Figure 1:
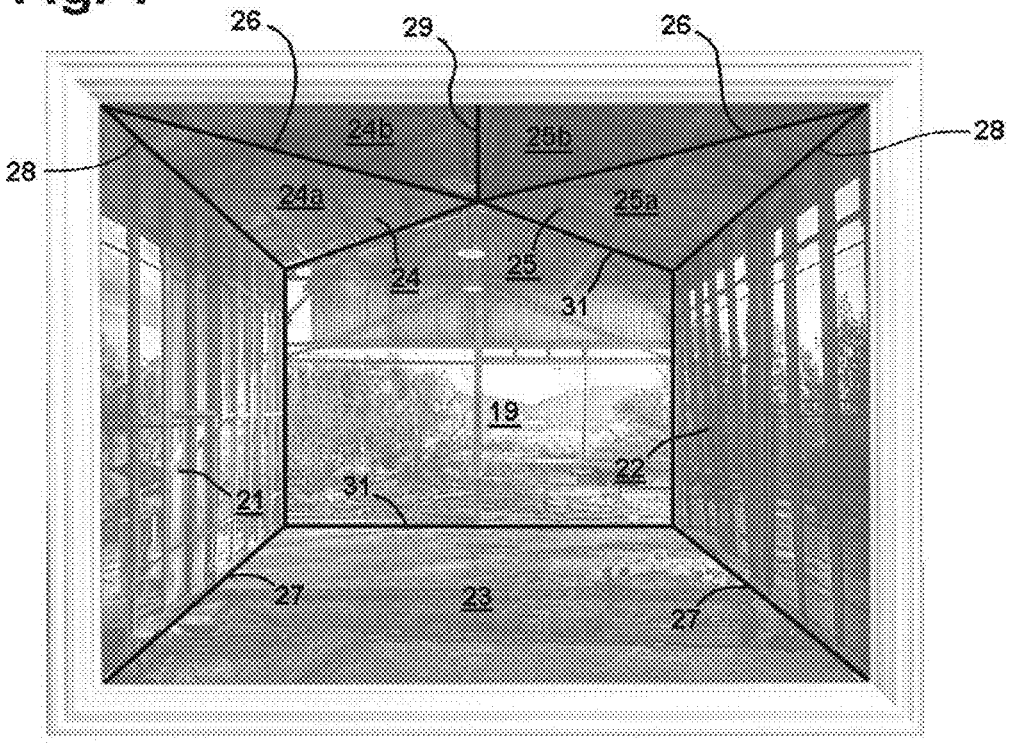
FIG. 1 is a front elevational view of one embodiment of a diorama according to the invention.

The diorama consists of a two-dimensional image 11 which has been adjusted and configured for three-dimensional display in a frame or container 12. The image can be of any desired subject, and typically is a photographic image, although it can also be a drawing, painting, or other form of image, if desired. In the embodiment illustrated in FIGS. 1-5, the frame or container is illustrated as being a five-sided, rectangular shadow box having an upper wall 13, a lower wall 14, side walls 16, 16, a rear wall 17, and an open front.

Figure 2:
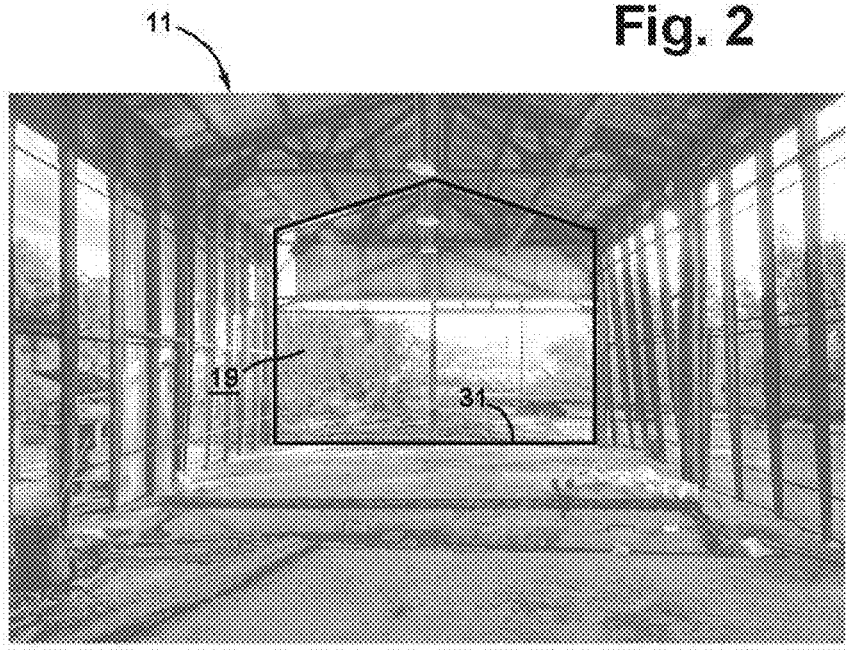
FIG. 2 a plan view of the original photograph in the embodiment of FIG. 1.
Figure 3A:
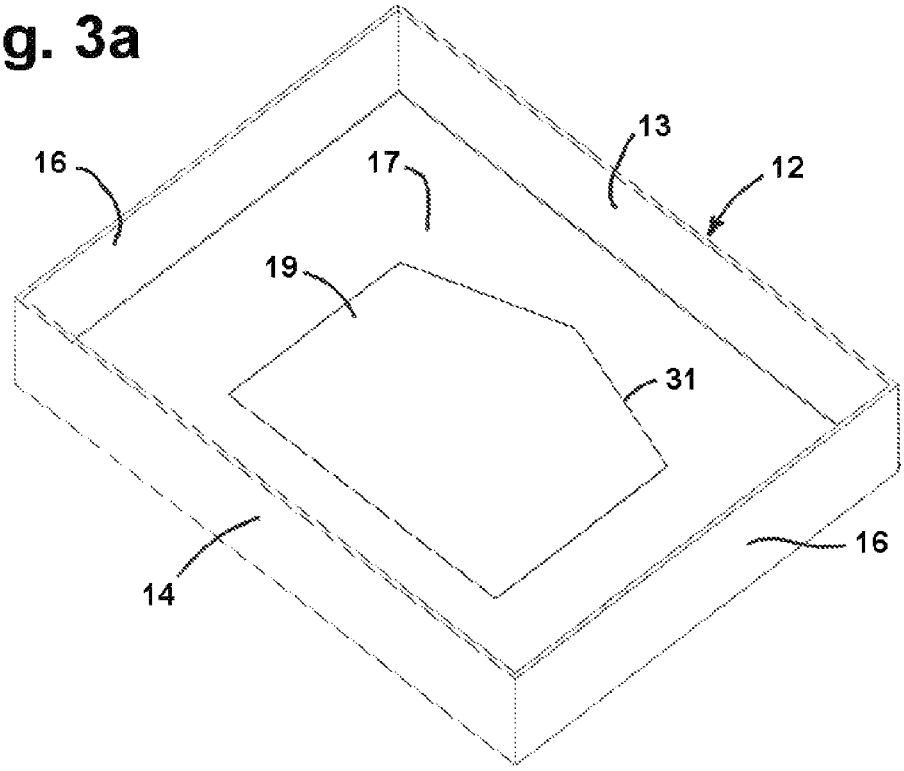

As shown in FIGS. 1 and 2, one section or panel of the image is selected as a background section or panel 19 which is positioned in a central location toward the rear of the box, as seen in FIG. 3*a*. This panel is of lesser width and height than the rear wall of the box, and additional sections or panels of the image extend between the edges of the central panel and the corresponding edges at the front of the box. In the embodiment illustrated, the primary subject is a partially completed garage, and the back wall of the garage has been selected as the background section which appears on the central panel 19 of the diorama. The side walls of the garage are depicted on panels 21, 22 which extend between the side edges of the central panel and the front edges of the sides of the box, and the floor of the garage is depicted on a panel 23 which extends between the lower edge of the central panel and the front edge of the lower wall of the box, with panels 21-23 being generally trapezoidal in shape.

In this particular example, the garage has a gable roof, and the back wall has two upper edges which extend between tops of the side walls and the ridge of the roof. The roof structure is depicted on panels 24, 25 which extend between the upper edges of the central panel and the front edge of the upper wall of the box. Since the top edges of the central panel are not parallel to the front edges of the box, the roof panels are folded along lines 26, 26 which extend between the peak of the central panel and the upper front corners of the box, to make the outer edges of the roof panels parallel to the edge of the box.

Panels 21-25 extend from the central, or back, panel at angles on the order of 30-45 degrees relative to the rear wall of the box, with adjacent edges of the panels coming together along lines which extend between the corners of the back panel and the front corners or edges of the box. Thus, the side panels and floor panel come together along lines 27, 27 which extend between lower corners of the back panel and the lower front corners of the box, and side panels and roof panels come together along lines 28, 28 which extend between upper corners at the sides of the back panel and the upper front corners of the box. The two roof panels come together along a line 29 which extends between the ridge or peak of the central panel and the midpoint of the front edge of the upper wall of the box. This three-dimensional configuration of the image provides a unique perspective effect that gives the diorama a very realistic appearance, particularly when the image is adjusted in the manner described below to align objects which appear in adjoining panels so that there will not be any discontinuities between the panels.

The first step in making the diorama is selecting the image and converting it to digital form if it is not already in digital form. Then, using a photo manipulation program, features such as colors, contrast, and sharpness are adjusted as desired or required. The area to be the background or central section of the diorama is selected and adjusted for squareness and/or parallelism with the photo manipulation program. The background section, indicated by outline 31 in FIG. 2, is then measured, the dimensions are recorded, and the adjusted image is stored as a discrete file.

The frame or container 12 is selected or constructed as desired. In the embodiment illustrated, it is in the form of a five-sided box having an open front and a rear wall of greater width and height than the background section of the photograph. In this particular embodiment, the background section has a width of 6.930 inches and a height of 4.469 inches on the sides, and the interior of the box is 12.75 inches wide, 9.75 inches high, and 2.44 inches deep. These dimensions are also recorded.

Next, a guide for the flat layout of the diorama is constructed. This can be done either with a three-dimensional CAD (computer-aided design) program or by hand using orthographic projection techniques. First, a three-dimensional drawing of the shadow box or frame is prepared, as illustrated in FIG. 3*a*, following which the outline 31 of background section of the diorama is drawn in the desired position on the rear wall of the box.

A three-dimensional model of the upper, lower, and side panels of the diorama is then constructed by drawing lines between the edges and corners of the background section and corresponding edges and corners of the frame or container. Thus, as illustrated in FIG. 3*b*, lines 27, 27 are drawn between lower corners of the back panel and the lower front corners of the box, lines 28, 28 are drawn between the upper corners at the sides of the back panel and the upper front corners of the box, a line 29 is drawn between the peak of the back panel and the midpoint of the front edge of the upper wall of the box, and fold lines 26, 26 are drawn between the peak of the back panel and the upper front corners of the box.

Figure 3B:
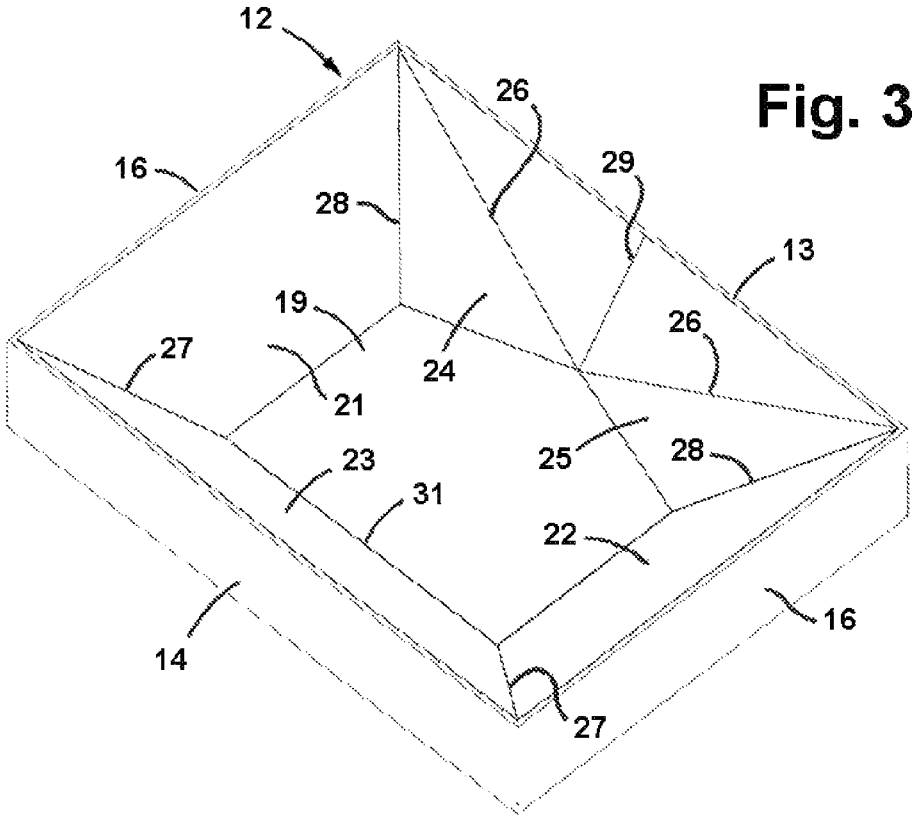

A flat, two-dimensional layout guide is then developed from the three-dimensional model of FIG. 3*b*. Initially, as illustrated in FIG. 3*c*, a two-dimensional projection of the model is drawn either manually or with software such as that utilized in the layout of sheet metal. In the two-dimensional representation, the edges of the panels which come together along lines 27-29 in the three-dimensional configuration are separated, as indicated by lines 27*a*, 27*b*; 28*a*, 28*b*; and 29*a*, 29*b*. These lines diverge outwardly from the corners of the back panel at angles corresponding to the angles of panels 21-25 in the finished diorama.

The two-dimensional projection of FIG. 3*c* is converted to an orthographic, or plan, view, as shown in FIG. 3*d*, with corner dividing lines 32 and concentric alignment arcs 33 being added to aid in the alignment of objects which appear in adjoining panels so that there will be no discontinuities in them when the panels of the image are folded up and brought together at their edges to form the diorama. The corner dividing lines emanate from the five corners of background panel 19 and are positioned midway between the lines defining the edges of panels 21-25. The concentric arcs are centered at the corners of the background panel and are spaced uniformly along the dividing lines, crossing the lines defining the edges of the panels. Guide lines 34 are added to the outer edges of the panels for use in constructing mounting tabs 36 which extend along the outer edges of panels 21-25 and are attached to the frame or box to hold the diorama in place.

The two-dimensional layout guide of FIG. 3*d* is then imported into the photo manipulation program. If the layout guide was generated with a CAD program, it is simply saved as a standard digital image file. If, however, the layout guide was drafted by hand, it is scanned electronically and then stored as a digital image file. In either case, the image of the layout guide is saved as a discrete file.

Using the layout guide as a template or guide, the two-dimensional photograph is converted into a three-dimensional diorama. For that purpose, the photograph and the image of the layout guide are opened in the photo manipulation program, making sure they both have the same bit depth and pixel density. The canvas size of the photograph is checked to make sure it is large enough to allow all of the layout guide to be seen when it is imported into the photograph, and increased if necessary.

Figure 4A:
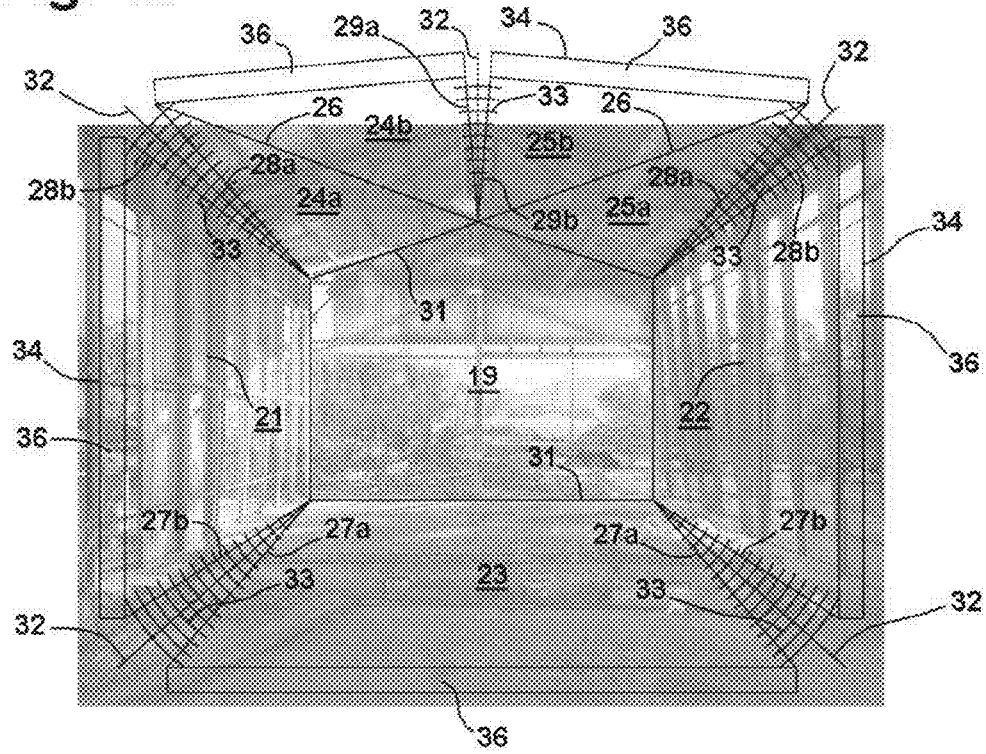
FIGS. 4*a*-4*d* are plan views illustrating the use of the layout guide in making the diorama of FIG. 1.

As illustrated in FIG. 4*a*, the layout guide is superimposed onto the photograph and masked so that only the layout lines are visible. The positions of the two images are then adjusted so that the background area of the photograph is aligned with the background section of the layout. At this point, not much of the photographic image other then the background area aligns with the layout guide, and the resolution of this incongruity is an important part of the invention.

Figure 4B:
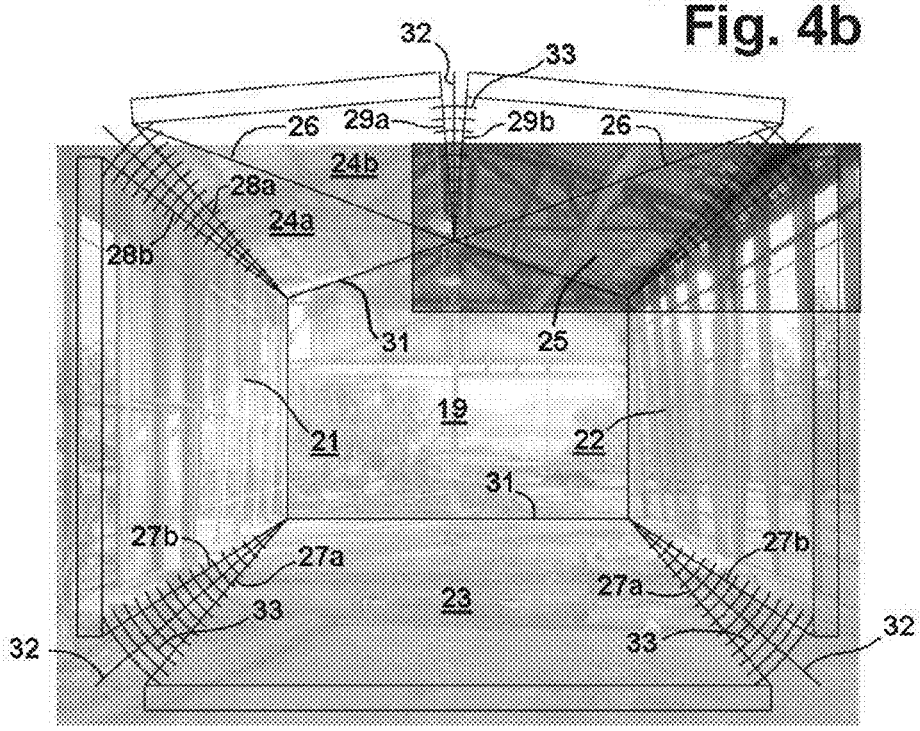

Using the editing tools of the photo manipulation program, the image is adjusted, one panel at a time, to match the layout guide. As illustrated in FIG. 4*b*, an area slightly larger than the panel to be worked on is selected, and a copy of that area is stored. Although it is possible to start with any of the panels, it is generally best to start with the panel that requires the greatest amount of adjustment, and in this particular example, the selected panel 25 is one of the two panels on which the roof structure is depicted.

Figure 4C:
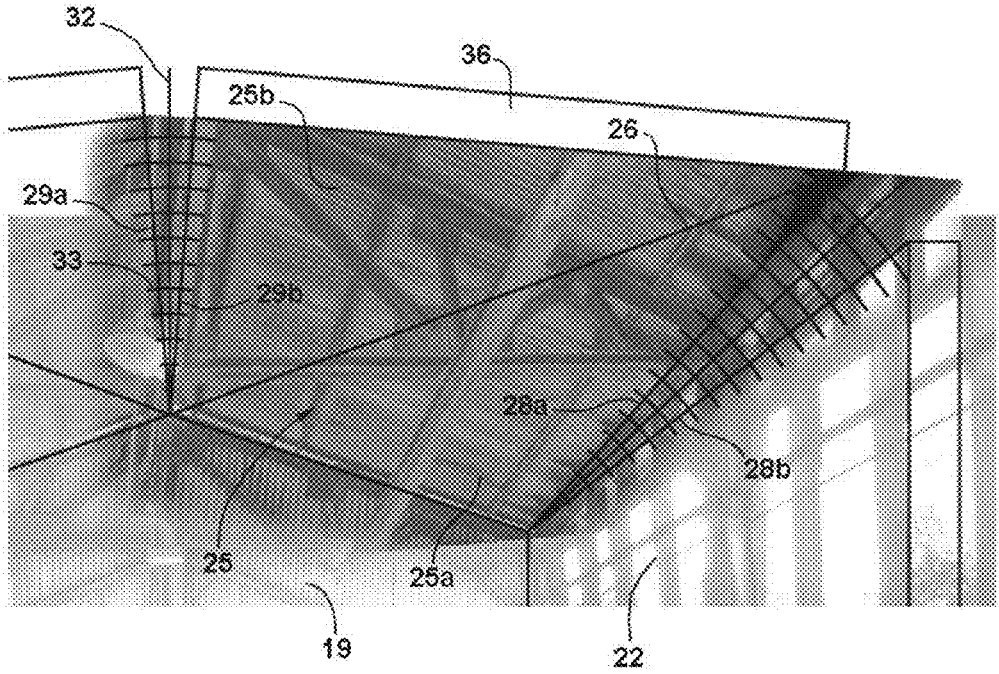

The shape and size of the selected panel are adjusted until the area to be seen in the diorama corresponds closely to the panel in the layout guide, as illustrated in FIG. 4*c*. The image can be twisted, stretched, compressed, and/or otherwise adjusted as desired with the photo manipulation program, using the concentric arcs 33 and corner dividing lines 32 as a reference, to align objects that appear in two panels on opposite sides of a dividing line or corner to provide continuity between the two panels.

Figure 4D:
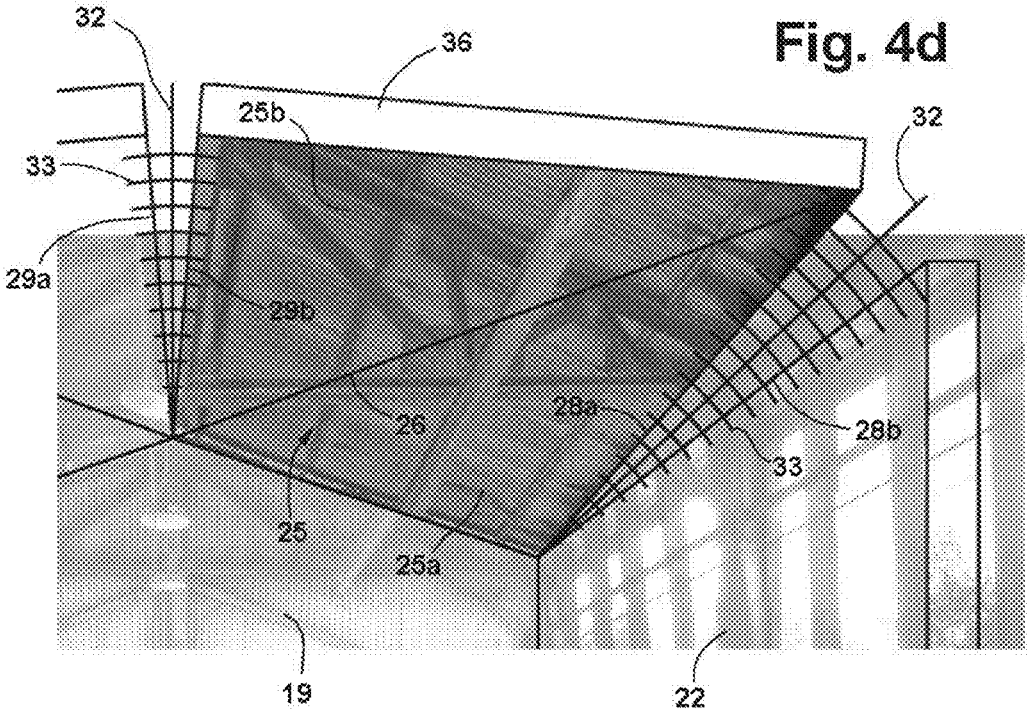

Since the selected area is larger than what is to be seen on the panel in the diorama, the excess must be removed, as illustrated in FIG. 4*d*. This is best done by masking the excess area with the program's masking tool since the image of the area removed can be unmasked later if needed to correct a discontinuity between portions of an object in adjacent panels. The excess areas can also be removed with the trimming or erasing tools of the program, but when those tools are used, the areas removed will no longer be available in the event they are needed later.

Figure 5:
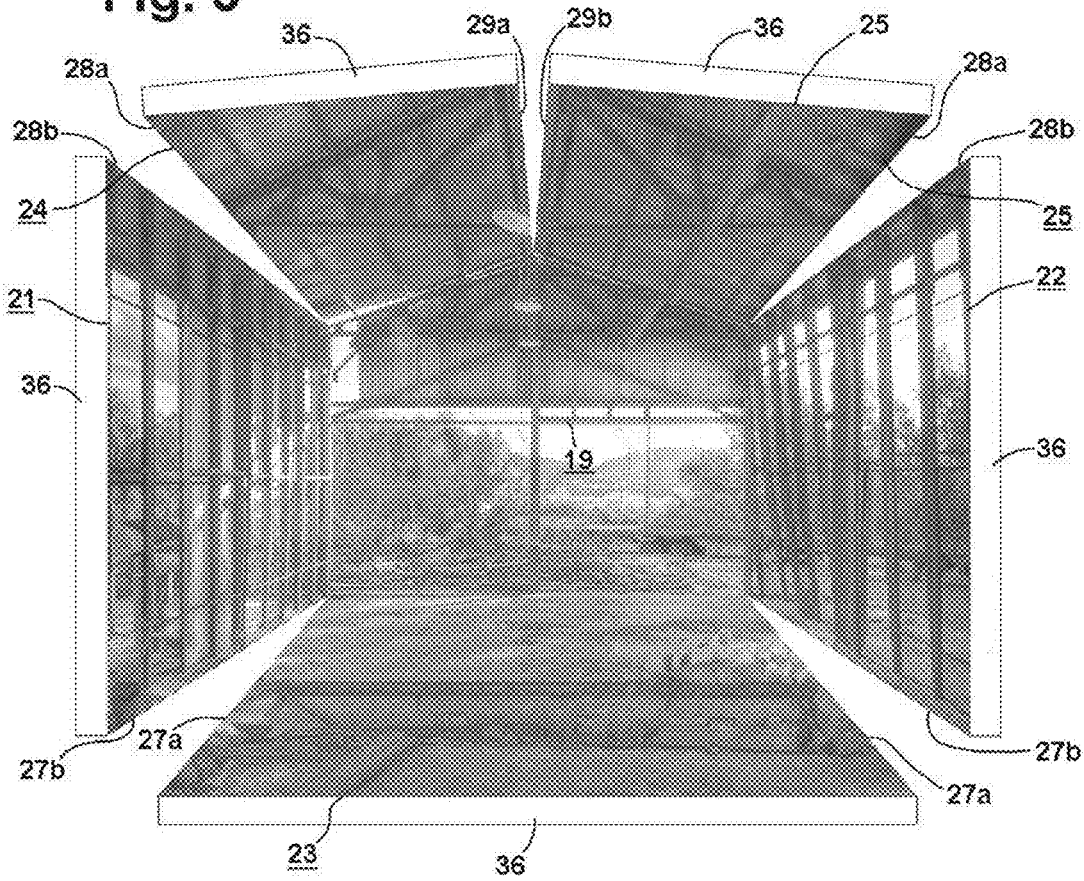
FIG. 5 is a plan view of the diorama in the embodiment of FIG. 1 in a flattened state prior to being formed into the three-dimensional configuration illustrated in FIG. 1.

Each of the other panels of the photograph is adjusted and trimmed in a similar manner, as illustrated in FIG. 5. These steps can then be repeated, as needed or desired, until all of the panels are precisely aligned with the lines on the layout guide. In the event that the re-sizing and distortion needed to fit each panel to the guide results in misalignment of portions of objects that appear in adjoining panels, such misalignment is corrected in a later step.

When the conversion process is complete, the fit of the diorama in the box or frame is checked by printing a full size proof of the flattened diorama and cutting it to the outline, as illustrated in FIG. 5. The proof sheet is then folded along the edges of the background panel to bring the adjacent edges of the other panels together along corner lines 25-29 and thereby give the diorama its three-dimensional shape. The abutting edges are secured together along the corner lines, and the folded proof sheet is placed in the shadow box or frame to check the overall size and fit. If necessary, the size and fit of the proof sheet are adjusted until the desired fit is achieved.

Each of the corners of the folded proof sheet is also checked for proper alignment of objects which appear in adjoining panels, and any misalignments are corrected with the editing tools of the image manipulation program, using the corner lines and arcs as a guide. This process is repeated until the alignment of the objects is as desired. In the event that proper alignment of one or more objects cannot be achieved, those objects can be relocated or removed.

Once all of the adjustments have been made, the final image of the flattened diorama is printed on photo paper, using printer settings that provide maximum clarity and impact. The flattened diorama is cut to the outline, as illustrated in FIG. 5. The diorama is then folded to its three-dimensional shape, and the edge portions of adjacent panels are joined together along the corner lines. The completed diorama is placed in the shadow box or frame, as illustrated in FIG. 1, and the mounting tabs are attached to the box or frame to hold the diorama in place.

In the embodiment of FIGS. 6-8, the diorama has a horizontally curved back panel 38, an upper panel 39 which extends forwardly and upwardly from the back panel, and a lower panel 41 which extends forwardly and downwardly from the rear panel, with the side edges of the back panel, the upper edge of the upper panel, and the lower edge of the lower panel extending along the front edges of the rectangular display frame or box (not shown) in which the diorama is mounted. Mounting tabs 42 extend along the outer edges of the panels for attachment to the display frame or box.

With the curved back panel, the lines 43, 44 along which the adjacent edges 43*a*, 43*b* and 44*a*, 44*b* of the panels come together are also curved, as are the edges of the panels. As in the embodiment of FIG. 1, corner dividing lines 46 and concentric alignment arcs 47 are included in the layout guide to aid in the alignment of objects which appear in adjoining panels so that there will be no discontinuities in them when the edges of the panels are brought together to give the diorama its three-dimensional configuration. The corner dividing lines extend along arcuate paths midway between the adjacent edges of the panels.

This embodiment is particularly suitable for panoramas and other wide format images, with the width of the three-dimensional diorama being substantially greater than the height and the width and the height both being substantially greater than the depth. As an example, the diorama in this embodiment might have a width of 35 inches, a height of 11 inches, and a depth of 4 inches, although it can have any dimensions and/or aspect ratio desired.

FIGS. 9 and 10 illustrate an embodiment in which the diorama 49 is mounted behind a rectangular opening 51 in a mat board 52. The mat board can be mounted in a suitable frame or box (not shown) or otherwise displayed, as desired. The diorama has a rectangular back panel 53, with side panels 54, 56, an upper panel 57, and a lower panel 58 extending between edges 53*a*-53*d* of the back panel and edges 51*a*-51*d* of the opening and coming together along lines 61-64 which extend between the corners of the back panel and the opening. With the back panel and the front edge of the diorama both being rectangular, panels 53-57 are trapezoidal in shape. Mounting tabs 66 extend outwardly from the front edges of the panels and are attached to the rear side of the mat around the opening.

In this embodiment, the back panel is relatively small and is positioned above the horizontal centerline of the diorama and asymmetrically of the opening in the mat board. Thus, lower panel 58 is longer or taller than upper panel 57 and extends from the plane of the back panel at a lesser angle than the upper panel. This gives an increased perception of depth to the portion of the image below the back panel, which in this particular example is the water downstream of a waterfall displayed on the back panel.

In the embodiment of FIGS. 11-22, an image 67 is digitized and processed with a photo manipulation program to adjust features such as color and contrast as desired or required. The size of the image is recorded, and an area 68 is selected as the background or central section of the diorama. If necessary, the squareness or parallelism of the area can be adjusted with the photo manipulation program. The size and position of the area relative to the overall image are measured and recorded, and the image is saved as a discrete file.

The interior dimensions (length, width, and depth) of the frame or container in which the image will be displayed are measured and recorded, and a three-dimensional model of the image in the frame is constructed. As illustrated in FIG. 12, a background panel 69 corresponding to background area 68 is drawn in the desired position on the back wall of a box-like frame 70, and lines 71-74 are drawn from the four corners of the background area to the front corners of the frame to define the upper, lower, and side panels 76-79 of the diorama.

Figure 13:
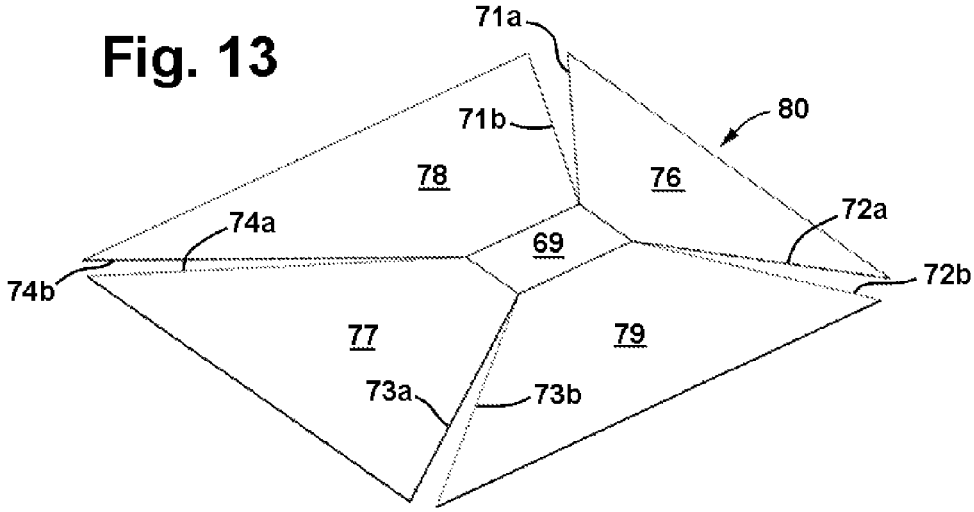
Figure 14:
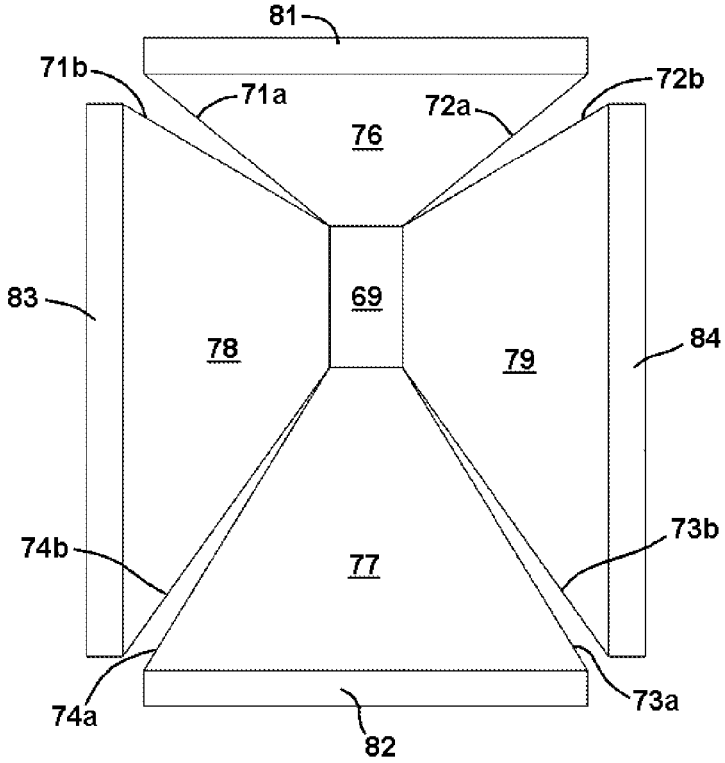

A two-dimensional layout guide 80 is then developed from the three-dimensional model of FIG. 12. As in the other embodiments, the first step in this process is the creation of a two-dimensional projection of the model, as shown in FIG. 13. That projection is then converted to an orthographic projection, or plan view, as seen in FIG. 14, with mounting tabs 81-84 extending along the outer edges of the upper, lower, and side panels of the diorama. In the two-dimensional projection, the edges 71*a*, 71*b*; 72*a*, 72*b*; 73*a*, 73*b*; and 74*a*, 74*b* of the top, bottom, and side panels diverge from the corners of central panel 69 at angles corresponding to the relative sizes of the image and the frame and the depth of the frame. The layout guide is saved as a digital image, then masked so that only the layout lines and the mounting tabs are visible. That image is then saved as a discrete image file.

Figure 15:
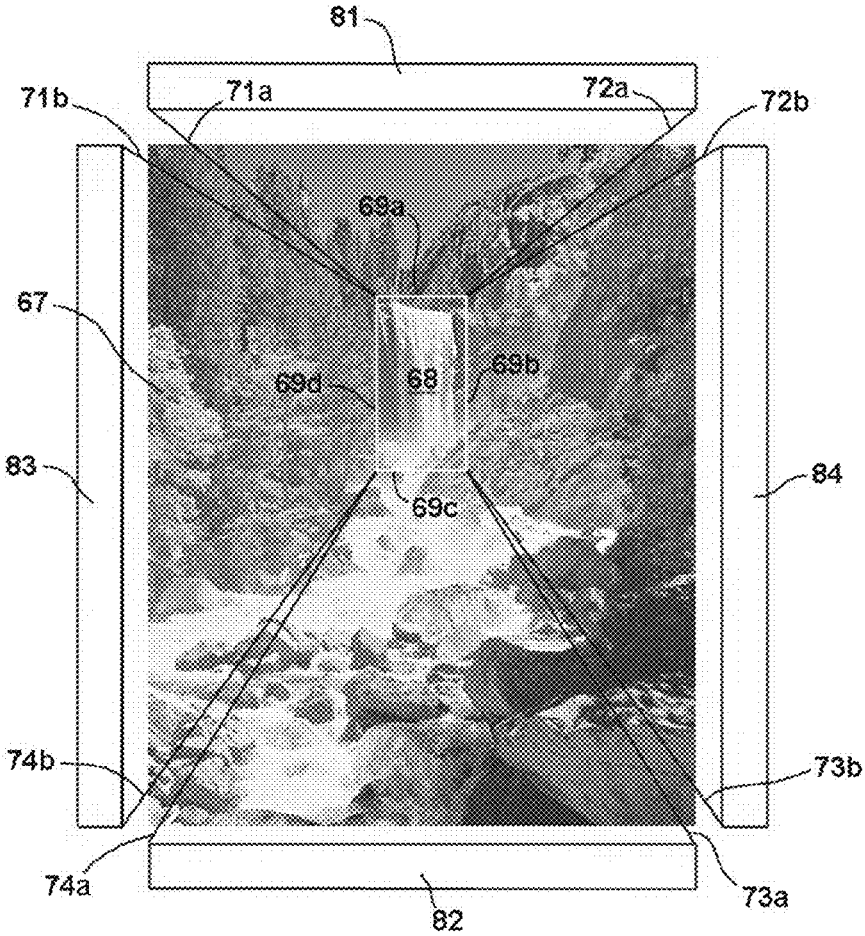

Using the layout guide, the two-dimensional image is converted to a diorama. The two files are opened and checked to verify that they have the same bit depth and pixel density. If the canvas size of the image is not large enough to allow all of the layout guide to be seen, the canvas size can be adjusted without changing the size of the image itself. The layout guide is then incorporated into the image, as illustrated in FIG. 15, with the guide on top of the image and the background area 68 of the image aligned with the lines 69*a*-69*d* which define background panel 69 of the diorama.

Figure 16:
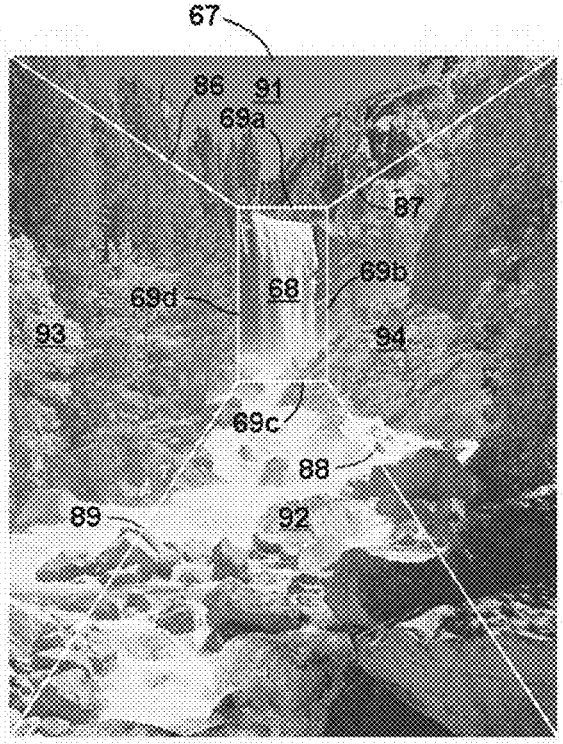
Figure 17:
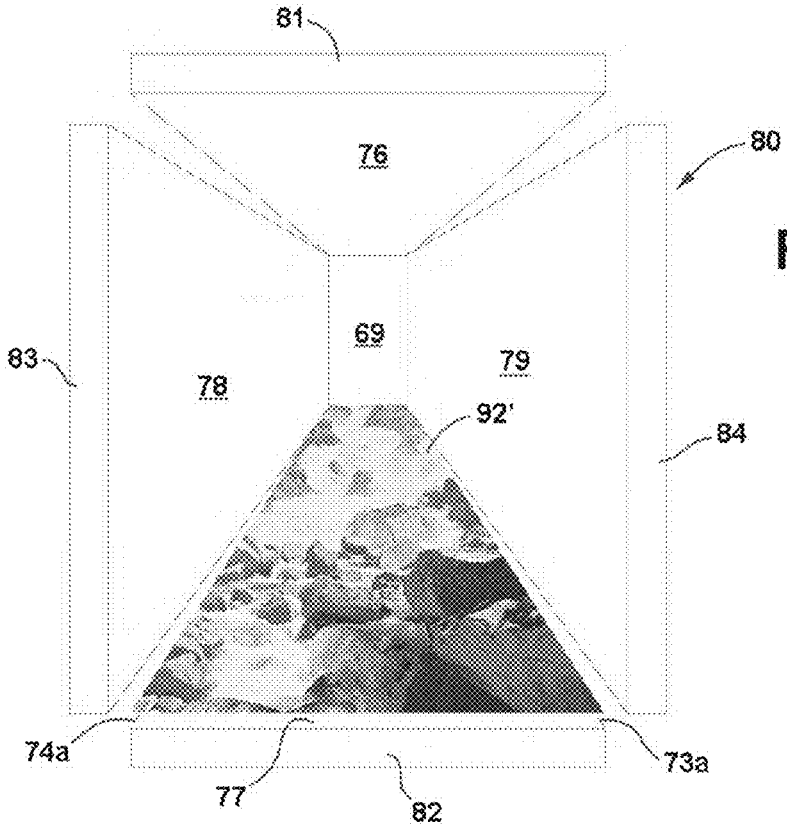
Figure 18:
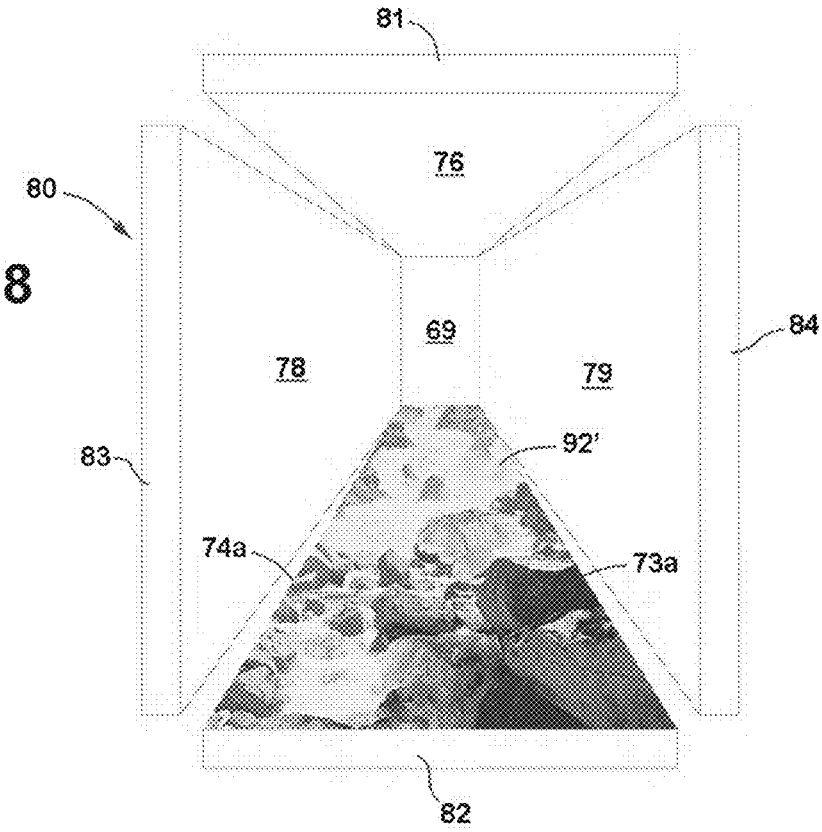
Figure 19:
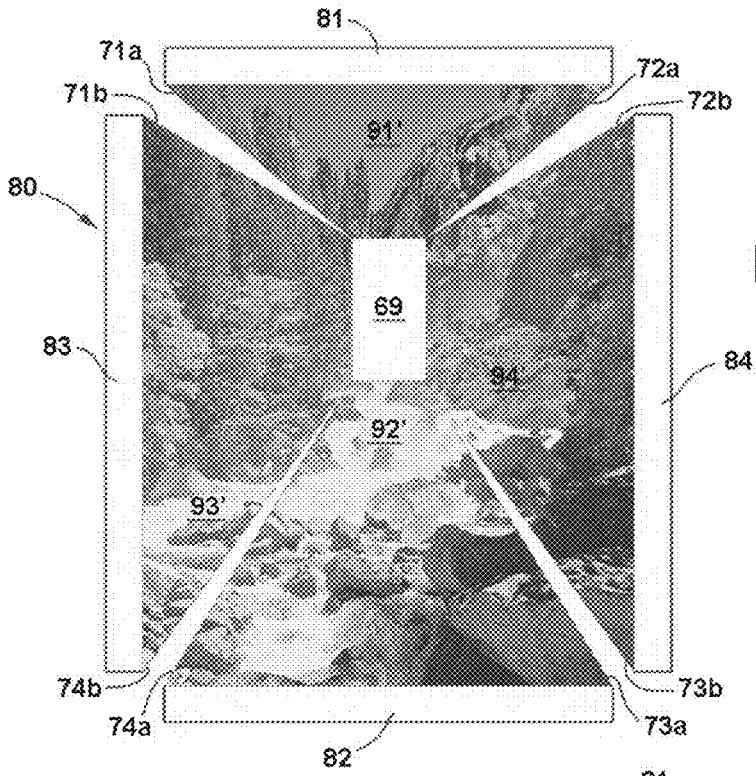

The layout guide is turned off, and the precise size and shape of the upper, lower, and side panels of the diorama are determined. As illustrated in FIG. 16, this is done by drawing straight lines 86-89 from the corners of the background area to the corresponding outer corners of the original image 67 to define the upper, lower, and side areas 91-94 of the image that will appear on the corresponding panels of the diorama. One by one, the areas of the image corresponding to the panels are selected and manipulated to correspond precisely to the layout guide. Thus, for example, as illustrated in FIG. 17, the foreground or lower area 92 of the image is carefully and precisely selected with the image manipulation software and duplicated. The original image is turned off, the layout guide is turned on, and using the editing tools available in the photo manipulating software, the size and shape of the duplicated area 92' are adjusted until the edges of that area are aligned precisely with the lines to the outline of the corresponding panel in the layout guide, as illustrated in FIG. 18. These steps are repeated for each of the other panels until the top, bottom, and side areas of the image all correspond precisely to the corresponding panels in the layout guide, as shown in FIG. 19.

Figure 20:
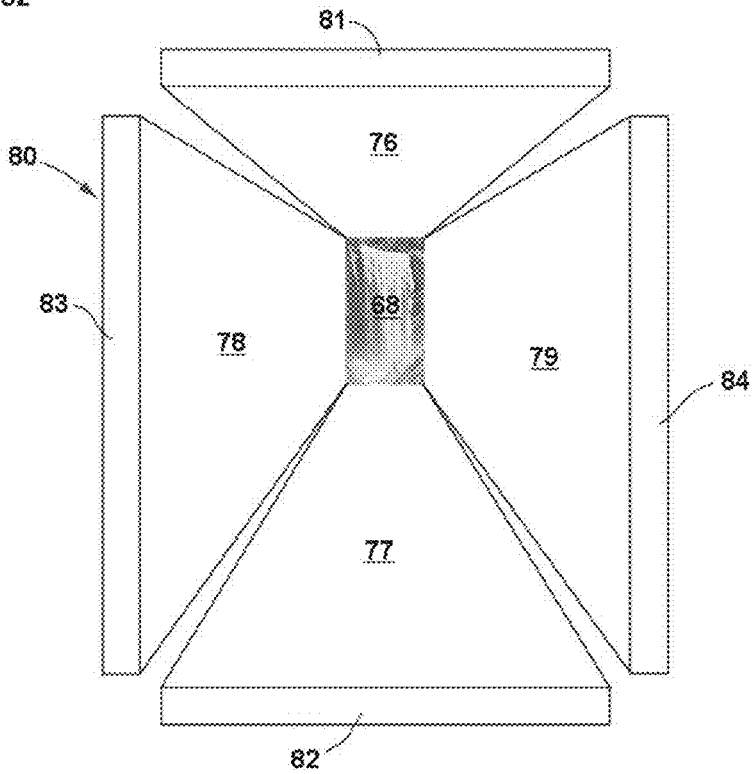
Figure 21:
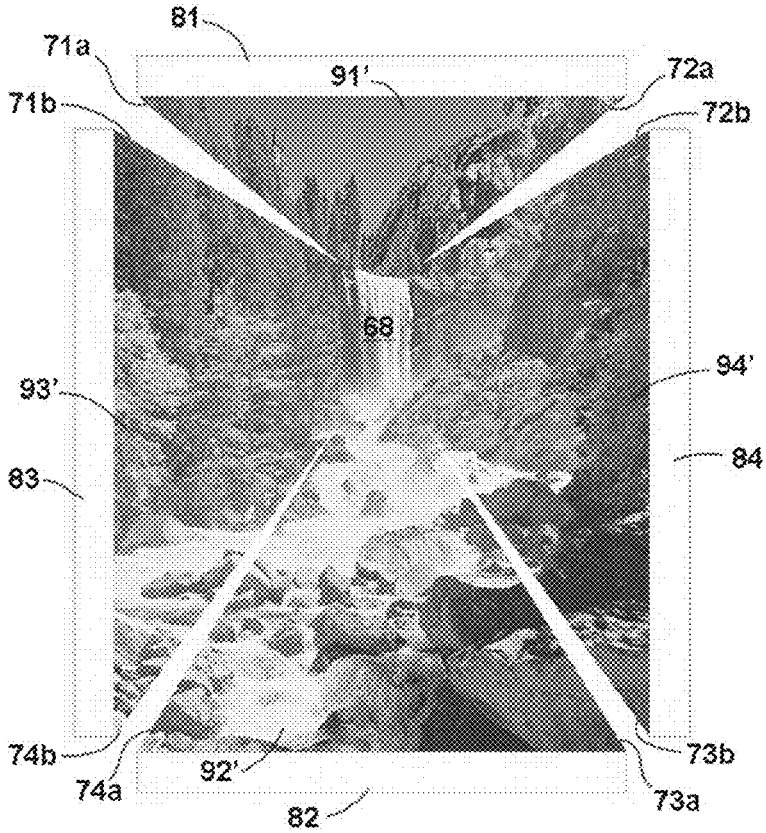

The background area is then incorporated into the adjusted image by turning off the upper, lower, and side areas of that image, turning on the original image and the layout guide, selecting an area slightly larger (e.g., 0.02 inch) than the outline of the background panel on the layout guide, and then masking all of the original image except the selected area, as illustrated in FIG. 20. The top, bottom and side panels 91'-94' of the adjusted image are then turned on again, and all of the lines on the layout guide except the mounting tabs are masked to complete the adjusted image, as shown in FIG. 21.

Figure 22:
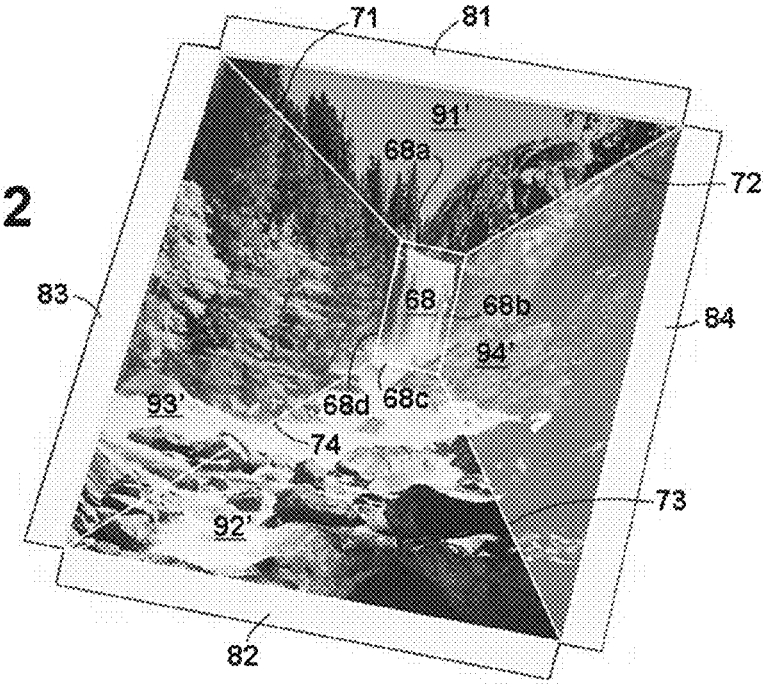

To complete the diorama, the adjusted image is printed, trimmed along the edges of the mounting tabs and panels, then folded along the edges 68*a*-68*d* of the background panel to bring the corresponding edges of the upper, lower, and side panels together along corners 71-74, as illustrated in FIG. 22. The mating edges are connected together, and the three-dimensional image is mounted in its frame.

Determining the precise size and shape of each panel to be manipulated greatly simplifies the process of making the diorama. With this simplified method, it is not necessary to use corner arcs or other guidelines to ensure proper alignment and continuity between objects that appear in the two panels on opposite sides of a corner in the three-dimensional image. If executed precisely, resizing and other adjustments are very consistent across the mating corners, and proofing is generally not required. In the event that an alignment problem does arise, it can be corrected by printing, trimming, and folding a proof of the adjusted image, checking the fit of the folded proof in the frame, checking each corner of the folded proof, and manipulating the affected areas of the image as described above and illustrated in FIGS. 17-19.

In the example of FIGS. 11-22, the diorama has five panels, including the background panel, but it will be understood that the invention can be employed with images having any desired numbers of panels.

The invention has a number of important features and advantages which allow a two-dimensional photograph or other image to be readily converted to a three-dimensional diorama that creates a genuine perspective which greatly augments the illusion of depth.

The invention can be also applied to applications other than the display of stationary images by using video display panels arranged in the manner disclosed herein, with the video signals displayed on the different panels being processed to provide continuity between them.

It is apparent from the foregoing that a new and improved diorama and method of making the same have been provided. While only certain presently preferred embodiments have been described in detail, as will be apparent to those familiar with the art, certain changes and modifications can be made without departing from the scope of the invention as defined by the following claims.

The invention claimed is:

1. A method of enhancing the perspective effect of a two-dimensional image, comprising the steps of: constructing a three-dimensional model of a diorama having a background panel on which a focal area of the image will appear and a plurality of other panels diverging outwardly from the background panel on which other areas of the image will appear, with adjacent edges of the panels coming together along corner lines, converting the three-dimensional model to a two-dimensional layout guide with lines outlining two-dimensional orthographic projections of the panels, selecting a focal area of the image having the same shape and size as the background panel of the diorama, selecting other contiguous areas of the image to appear on the other panels of the diorama, adjusting the shape and size of each of the other selected areas of the two-dimensional image to match the size and shape of a corresponding one of the orthographic projections of the other panels on the layout guide, printing an adjusted image consisting of the focal area and the orthographically adjusted areas of the two-dimensional image arranged in accordance with the panels on the layout guide, trimming the printed image along facing edges of adjacent ones of the panels, and forming the printed image into the three-dimensional configuration of the diorama, with the facing edges coming together along the corner lines and the adjusted image flowing smoothly and continuously between the panels with an enhanced perspective effect and depth.

2. The method of claim 1 including the step of mounting the three-dimensional printed image in a frame, with the focal area on a background panel spaced behind the front of the frame and the other panels extending between the edges of the background panel and corresponding edges of the frame.

3. The method of claim 1 wherein the three-dimensional model of the diorama is constructed by making a three-dimensional drawing of a box in which the diorama is to be displayed, drawing the shape of the focal area on a rear wall of the box to define the background panel, and drawing lines from corners of the background panel to corners of the box to define the other panels.

4. The method of claim 1 wherein the shape and size of selected areas of the two-dimensional image are adjusted by marking a background area corresponding in size and shape to the focal area of the diorama on the two-dimensional image, drawing lines from the corners of the background area to corresponding corners of the two-dimensional image to establish outlines of panels surrounding the background area, selecting and making copies of selected areas of the two-dimensional image bounded by the outlines on the image, and individually adjusting the shape and size of the copies of the selected areas to correspond precisely to the outlines of the panels on the layout guide.

5. The method of claim 4 including the steps of turning off the adjusted copies of the selected areas, turning on the two-dimensional image and the layout guide, masking all of the two-dimensional image except the focal area defined by the lines on the layout guide, turning off the layout guide, and turning on the copies of the adjusted selected areas in combination with the unmasked focal area to form the adjusted image.

6. The method of claim 1 including the step of including reference lines in the layout guide which extend along arcuate paths between adjacent ones of the panels, and aligning portions of objects appearing in adjacent ones of the panels with the reference lines so that the portions of the objects in adjacent panels are aligned with each other and flow continuously between the panels when the edges of the panels are brought together.

7. A method of making a diorama from a two-dimensional image, comprising the steps of: graphically constructing a three-dimensional model of the diorama in the form of a background panel and a plurality of other panels on which different areas of the image will appear, converting the three-dimensional model to a two-dimensional layout guide with lines outlining the panels, superimposing the layout guide on the two-dimensional image and aligning a background area of the image with the background panel of the guide, drawing lines from corners of the background area to corresponding corners of the image to define other areas of the image corresponding to the other panels, making copies of the other areas, individually adjusting the shape and size of each of the copies to correspond precisely to the outlines of the panels on the layout guide, masking all of the two-dimensional image except the background area, combining the adjusted copies of the other areas with the unmasked background area to form an adjusted image, printing the adjusted image, trimming the printed image along facing edges of adjacent ones of the panels, and bringing the trimmed edges together to form a continuous three-dimensional image.

8. The method of claim 7 including the step of mounting the three-dimensional printed image in a frame, with a background panel spaced behind the front of the frame and the other panels extending between the edges of the background panel and corresponding edges of the frame.

9. The method of claim 7 wherein the three-dimensional model of the diorama is constructed by making a three-dimensional drawing of a box in which the diorama is to be displayed, drawing the shape of the background area on a rear wall of the box to define the background panel, and drawing lines from corners of the background area to corners of the box to define the other panels.

10. A method of making a diorama in the form of an enhanced perspective image, comprising the steps of: selecting a section of a two-dimensional image with perspective content as a focal area for the diorama, constructing a three-dimensional model of the diorama with a background panel corresponding in size and shape to the focal area and other panels on which other areas of the image will appear diverging outwardly from the background panel, with adjacent edges of the panels coming together along corner lines, constructing a layout guide in the form of a two-dimensional orthographic projection of the model with lines outlining the panels on the layout guide, superposing the two-dimensional image and the layout guide so that the section of the image selected as the focal area is aligned with the background panel of the layout guide, selecting contiguous areas of the two-dimensional image for display on adjacent ones of the other panels of the diorama, adjusting the shape and size of selected areas to fit precisely within the outline for a corresponding one of the panels on the layout guide, printing an image of the focal area and the adjusted areas arranged in accordance with the layout guide, trimming the printed image along facing edges of adjacent ones of the panels on which the adjusted areas appear, and bringing the facing edges together along the corner lines to form a three-dimensional image of enhanced perspective effect and depth that flows smoothly and continuously between the panels.

11. A method of making a diorama from a two-dimensional image, comprising the steps of: graphically constructing a three-dimensional model of the diorama in the form of a plurality of panels on which different sections of the image will appear, converting the three-dimensional model to a two-dimensional layout guide with guide lines outlining orthogonal projections of the panels, superposing the layout guide and the two-dimensional image, adjusting the shape and size of selected areas of the two-dimensional image to precisely match the orthogonal projections of the panels so that portions of objects in appearing on adjacent panels will be precisely aligned with each other when the panels are brought together, printing the adjusted image, trimming the printed image along facing edges of adjacent ones of the panels, and bringing the trimmed edges together to form a three-dimensional image of enhanced perspective effect that flows smoothly and continuously between the panels without discontinuities between portions of objects appearing in adjoining ones of the panels.

12. The method of claim 11 including the step of mounting the three-dimensional printed image in a frame, with a background panel spaced behind the front of the frame and the remaining panels extending between the edges of the background panel and corresponding edges of the frame.

13. The method of claim 11 wherein the three-dimensional model of the diorama is constructed by making a three-dimensional drawing of a box in which the diorama is to be displayed, selecting a central area of the two-dimensional image as a background area, drawing the shape of the background area on a rear wall of the box to define a background panel, and drawing lines from corners of the background area to corners of the box to define the remaining panels.

14. The method of claim 11 wherein the three-dimensional model is constructed and converted to a two-dimensional layout guide on a computer.

15. The method of claim 11 wherein the selected areas of the two-dimensional image differ in size from the panels, and excess portions of the selected areas are removed after the shape and size of selected areas have been adjusted to match the guide lines.

16. The method of claim 15 wherein the excess areas are removed by masking in a photo manipulation program on a computer.

17. The method of claim 11 including the step of including lines in the layout guide for use in aligning the portions of objects appearing in adjoining panels with each other.

18. The method of claim 17 wherein the lines for use in aligning the portions of the objects include corner lines disposed between the lines defining facing edges of adjacent panels and a plurality of spaced apart reference lines extending between the lines defining the facing edges.

* * * * *